US009789933B1

(12) United States Patent
Dusk et al.

(10) Patent No.: US 9,789,933 B1
(45) Date of Patent: Oct. 17, 2017

(54) APPARATUS FOR TOWING PERSONAL WATERCRAFT

(71) Applicants: Richard Dusk, Brampton (CA); Mark Lariviere, Orillia (CA); Tim Chapman, Etobicoke (CA)

(72) Inventors: Richard Dusk, Brampton (CA); Mark Lariviere, Orillia (CA); Tim Chapman, Etobicoke (CA)

( * ) Notice: Subject to any disclaimer, the term of this patent is extended or adjusted under 35 U.S.C. 154(b) by 0 days.

(21) Appl. No.: 15/250,145

(22) Filed: Aug. 29, 2016

Related U.S. Application Data

(60) Provisional application No. 62/319,503, filed on Apr. 7, 2016.

(51) Int. Cl.
*B63B 21/58* (2006.01)

(52) U.S. Cl.
CPC ..... *B63B 21/58* (2013.01)

(58) Field of Classification Search
CPC ..... B63B 21/56
See application file for complete search history.

(56) References Cited

U.S. PATENT DOCUMENTS 4,947,779 A * 8/1990 Grinde ..... B63B 21/56 114/250
5,018,473 A * 5/1991 Foster ..... B63B 23/32 114/249

* cited by examiner

*Primary Examiner* — Edwin Swinehart

(57) ABSTRACT

An apparatus for towing a personal watercraft, including a towing member and a stabilizing member. The towing member is configured to attach a rear portion of the towing watercraft to a front portion of the personal watercraft. The stabilizing member comprises an elongated rigid body configured to attach to the rear portion of the towing watercraft and to extend to a stabilization point above a rear portion of the personal watercraft, and a flexible line member extending from the stabilization point of the elongated rigid body for attachment to the rear portion of the personal watercraft. The flexible line member is configured to limit lateral movement of the rear portion of the personal watercraft relative to the towing watercraft.

28 Claims, 15 Drawing Sheets

APPARATUS FOR TOWING PERSONAL WATERCRAFT

RELATED APPLICATION

This application claims the benefit of priority under 35 U.S.C. 119(e) to U.S. Provisional Patent Application Ser. No. 62/319,503, filed Apr. 7, 2016, which is hereby incorporated by reference in its entirety.

FIELD OF THE INVENTION

The invention relates to devices for towing watercraft, particularly for towing a first watercraft behind a second watercraft.

BACKGROUND OF THE INVENTION

Known devices for towing personal watercraft behind a boat have many shortcomings. For example, many towing devices allow the personal watercraft to jackknife and swing out beyond the side of the boat. Other devices which place the personal watercraft directly on top of the boat's swim platform are expensive, add considerable weight to the stern of the boat, and interfere with the availability and use of the swim platform. The weight of the personal watercraft on the stern of the boat can also interfere with planing.

SUMMARY OF THE INVENTION

The invention provides a device for towing a personal watercraft behind a towing watercraft, the device including a combination of a towing member and a stabilizing member. The towing member attaches the rear portion of the towing watercraft to the front portion of the personal watercraft, so that forward motion of the towing watercraft pulls the personal watercraft forward. The stabilizing member has an elongated rigid body that extends from the rear portion of the towing watercraft to a point located above the rear portion of the personal watercraft, and a connecting member that connects the elongated rigid body to the rear portion of the personal watercraft.

The device may include a base that attaches to both the towing member and the stabilizing member. The base may be configured to attach to a rear portion of the towing watercraft, such as the swim platform. The device preferably takes up very little space on the swim platform, and can be manufactured and sold at a relatively low cost.

The inventors have appreciated that, in at least some embodiments of the invention, the device provides an improved towing mechanism that prevents the personal watercraft from jackknifing or swinging out beyond the side of the towing watercraft, even when backing up. This is very useful when docking or in the use of locks. It also prevents the personal watercraft from interfering with or hitting other craft when going through a channel with other boats in the vicinity. In preferred embodiments, the device may also be used in a full plane mode (with the watercraft travelling at full speed). In preferred embodiments, the device offers a very stable and inexpensive means of towing a personal watercraft behind a larger watercraft, such as a motorized yacht or the like.

Accordingly, in one aspect, the present invention resides in a device for towing a personal watercraft behind a towing watercraft, comprising: a base configured for attachment to a rear portion of the towing watercraft; a rigid towing member extending between a first towing member end and a second towing member end, the first towing member end having an associated first connecting portion that connects the first towing member end to the base, the first connecting portion being configured to permit vertical rotation of the towing member relative to the base about a lateral axis, and to prevent rotation of the towing member relative to the base about a vertical axis and a longitudinal axis, the second towing member end having an associated second connecting portion that is configured for attachment to a front portion of the personal watercraft; and a stabilizing member comprising: an elongated rigid body extending between a first elongated body end and a second elongated body end, the first elongated body end being rigidly connected to the base, the elongated rigid body being configured to extend from the base over the personal watercraft, with the second elongated body end positioned above a rear portion of the personal watercraft, and a connecting member that extends from the second elongated body end for attachment to the rear portion of the personal watercraft, the connecting member being configured to limit lateral movement of the rear portion of the personal watercraft relative to the towing watercraft.

In some embodiments, the base is configured for attachment to a swim platform of the towing watercraft.

The base may comprise: a plate that is configured to be secured to the rear portion of the towing watercraft; and a connecting body that is releasably secured to the plate; wherein the first towing member end and the first elongated body end are connected to the connecting body.

In some embodiments, the connecting body has an elongated dovetail shaped projection; and the plate has a complementary dovetail shaped channel for slidingly receiving the dovetail shaped projection.

The base may further comprise a spring-loaded pin for releasably securing the connecting body to the plate.

In some embodiments, the first connecting portion comprises a hinge with a selectively removable pin that extends along the lateral axis; and the rigid towing member is configured to disconnect from the base when the pin is removed.

The rigid towing member may comprise a step platform.

In some embodiments, the second connecting portion is configured to allow horizontal rotation and vertical rotation of the personal watercraft relative to the rigid towing member. The second connecting portion may comprise a hook.

In some embodiments, a length of the connecting member extending from the second elongated body end is adjustable. A length of the elongated rigid body may also be adjustable.

In some embodiments, the elongated rigid body is selectively removable from the base.

The connecting member may comprise a flexible line member, and the elongated rigid body may comprise a rod.

In some embodiments, the rod is a telescopic rod. The telescopic rod may comprise a plurality of tubular sections that are connected by quick release button connectors. Optionally, the telescopic rod is releasably secured to the base by a quick release button connector. The telescopic rod may have an extended length of at least 4 m and a collapsed length of less than 2 m.

In some embodiments, the rod defines an internal channel and the line member extends from the base to the second elongated body end through the internal channel. The base may comprise a cleat for adjustably securing the line member to the base.

In some embodiments, the line member comprises a rope.

In some preferred embodiments, a tension of the line member is adjustable.

The connector member may be configured to attach to a rear grab handle of the personal watercraft.

In some preferred embodiments of the invention, the rigid towing member has a flat upper surface.

In some embodiments, the rigid towing member has a lateral width of at least 10 cm.

In some embodiments, the first towing member end has a first lateral width and the second towing member end has a second lateral width, the first lateral width being greater than the second lateral width.

The rigid towing member may have a plurality of holes extending from a bottom surface of the rigid towing member to the flat upper surface.

In another aspect, the present invention resides in a method of towing a personal watercraft behind a towing watercraft using the aforementioned device. The method may comprise: attaching the base to the rear portion of the towing watercraft; attaching the second towing member end to the front portion of the personal watercraft using the associated second connecting portion; attaching the connecting member to the rear portion of the personal watercraft; and moving the towing watercraft forward through a waterway, with the device pulling the personal watercraft behind the towing watercraft.

In some embodiments of the invention, the method may further comprise one or more of the following steps: attaching the base to the swim platform of the towing watercraft; securing the plate to the rear portion of the towing watercraft; securing the connecting body to the plate; connecting the rigid towing member to the base; connecting the elongated rigid body to the base; adjusting the length of the elongated rigid body; adjusting the length and/or the tension of the flexible line member; securing the line member to the base and/or the cleat; attaching the connector member to the rear grab handle of the personal watercraft; and moving the towing watercraft backwards through the waterway, with the device keeping the personal watercraft substantially longitudinally aligned with the towing watercraft. In some embodiments, the device is packaged and/or stored in a partially or fully disassembled state, and the method comprises assembling the device.

In a further aspect, the present invention resides in a combination of a towing member and a stabilizing member for towing a first watercraft behind a second watercraft, the towing member being configured to attach a rear portion of the second watercraft to a front portion of the first watercraft; the stabilizing member comprising: an elongated rigid body configured to attach to the rear portion of the second watercraft and to extend to a stabilization point above a rear portion of the first watercraft; and a flexible line member extending from the stabilization point of the elongated rigid body for attachment to the rear portion of the first watercraft; wherein the flexible line member is configured to limit lateral movement of the rear portion of the first watercraft relative to the second watercraft; and wherein the flexible line member is configured to limit longitudinal movement of the first watercraft relative to the second watercraft, so that the front portion of the first watercraft remains spaced from the rear portion of the second watercraft.

BRIEF DESCRIPTION OF THE DRAWINGS

Further aspects and advantages of the invention will appear from the following description taken together with the accompanying drawings, in which.

DETAILED DESCRIPTION OF THE DRAWINGS

Figure 3:
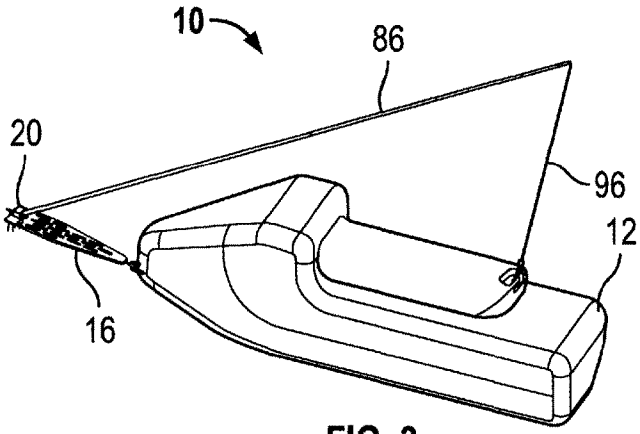
FIG. 3 shows a perspective view of the device of FIG. 1.

A device 10 for towing a personal watercraft 12 behind a towing watercraft 14 is shown in FIGS. 1 to 18. The device 10 includes a towing member 16, a stabilizing member 18, and a base 20.

Figure 5:
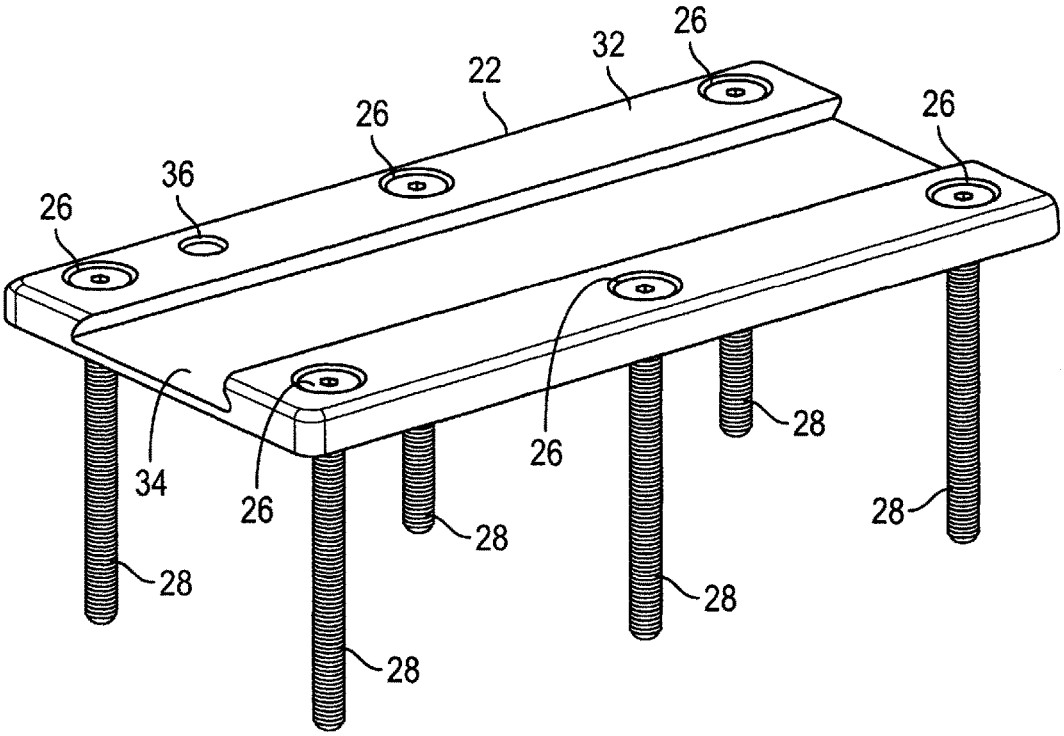
FIG. 5 shows a perspective view of a base plate of the device of FIG. 1.

The base 20 comprises a base plate 22 and a removable base connecting body 24. The base plate 22 is best shown in FIG. 5 as an aluminum plate with a set of screw holes 26 for receiving screws 28. The screws 28 are used to secure the base plate 22 to a swim platform 30 at the rear (stern) of the towing watercraft 14. The base plate 22 has a low profile, and thus is a relatively unintrusive presence on the swim platform 30. The base plate 22 may be attached to the swim platform 30 more or less permanently, without significantly interfering with the use of the swim platform 30. The base plate 22 may, of course, be removed when desired by removing screw 28. In the exemplary embodiment which is shown, the base plate 22 has a lateral width of about 300 mm, a longitudinal length of about 150 mm, and a vertical height of about 15 mm. Other suitable dimensions and materials may be selected as desired.

The base plate 22 has a dovetail shaped channel 34 that runs laterally across the top surface 32 thereof. The top surface 32 also has a bore hole 36. The channel 34 and the bore hole 36 are used for attaching the base connecting body 24 to the base plate 22, as will be described in more detail below.

Figure 7:
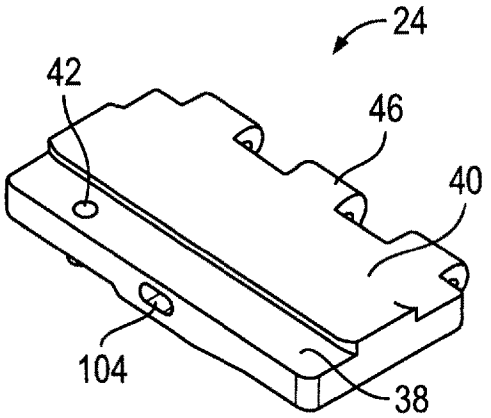
FIG. 7 shows a bottom perspective view of the base connecting body of FIG. 6.
Figure 6:
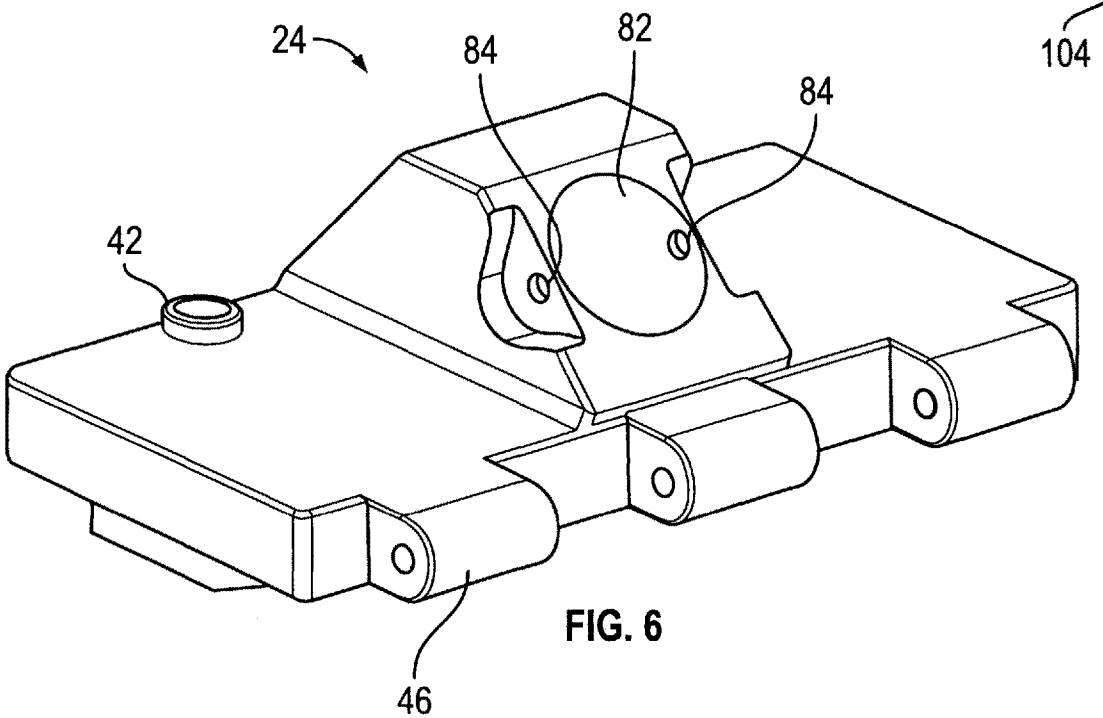
FIG. 6 shows a top perspective view of a base connecting body of the device of FIG. 1.

The base connecting body 24 is best shown in FIGS. 6 and 7 as an aluminum body configured for attachment to the base plate 22. In particular, a bottom surface 38 of the connecting body 24 has a dovetail shaped projection 40 with a size and shape that is complementary to the dovetail shaped channel 34, so that the dovetail shaped projection 40 can be slidingly received within the channel 34. Optionally, the dovetail shaped projection 40 has a lead-in chamfer to assist with insertion of the projection 40 into the channel 34.

Figure 8:
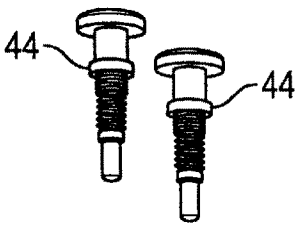
FIG. 8 shows a spring loaded pin for securing the base connecting body of FIG. 6 to the base plate of FIG. 5.

The connecting body 24 also has a pin receiving hole 42 for receiving a stainless steel spring loaded pin 44, as shown in FIG. 8. The spring loaded pin 44 is used to lock the base connecting body 24 to the base plate 22. In particular, when the pin 44 is screwed in place in the pin receiving hole 42, and the dovetail shaped projection 40 is slidingly received by the dovetail shaped channel 34 so that the hole 42 is aligned with the bore hole 36, the spring action of the pin 44 extends the pin 44 downwards into the bore hole 36, holding the connecting body 24 and the base plate 22 together. The connecting body 24 can furthermore be easily removed from the base plate 22 when desired, by pulling the pin 44 upwards and sliding the dovetail shaped projection 40 out of the channel 34. When the towing device 10 is not in use, the connecting body 24 can be easily removed to reduce interference with use of the swim platform 30.

Figure 15:
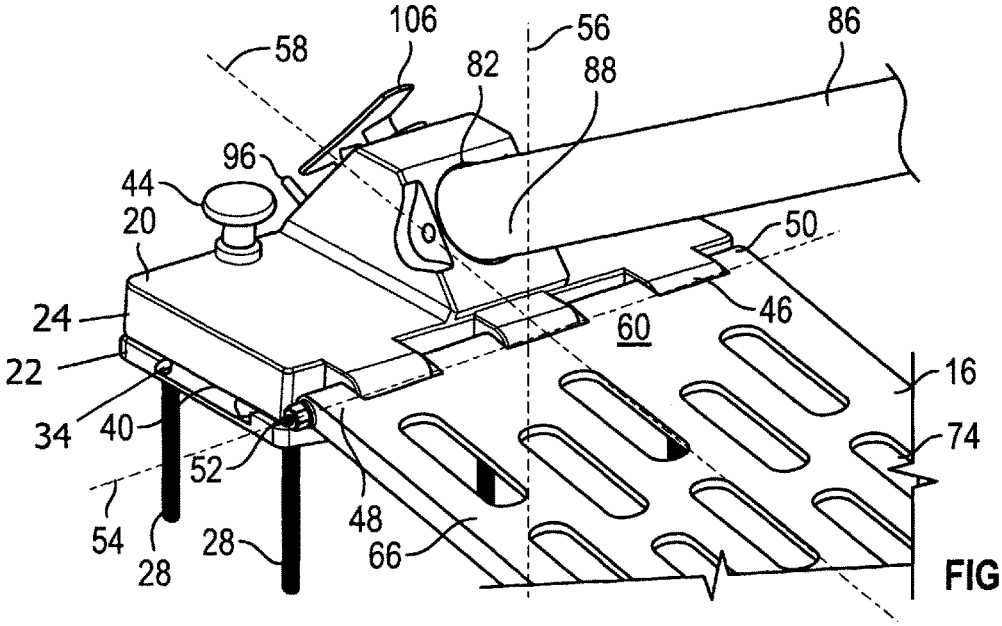
FIG. 15 shows a close-up front perspective view of a base of the device of FIG. 1.
Figure 16:
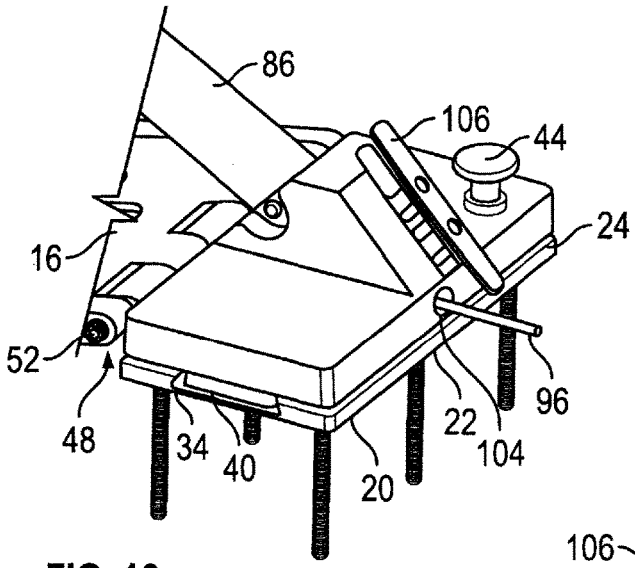
FIG. 16 shows a rear perspective view of the base of FIG. 15.

The connecting body 24 has a hinge portion 46 for forming a hinge connection 48 in conjunction with a complementary hinge portion 50 of the towing member 16, as shown in FIG. 15. The hinge connection 48 is formed by aligning the hinge portion 46 of the connecting body 24 with the hinge portion 50 of the towing member 16, and inserting a removable hinge pin 52 through the aligned hinge portions 46 and 50 along a lateral axis 54. Optionally, the hinge pin 52 is tethered to the connecting body 24, to prevent accidentally dropping the hinge pin 52 into the water when installing or uninstalling the device 10. The hinge connection 48 permits vertical rotation of the towing member 16 relative to the connecting body 24 about the lateral axis 54, and prevents rotation of the towing member 16 about a vertical axis 56 and a longitudinal axis 58. The hinge connection 48 permits the towing member 16 to rotate up to 90 degrees relative to the swim platform 30. The exemplary hinge pin 52 which is shown is a ⅜" rod with a ⅜" (24 UNC) thread secured with a locknut.

Figure 9:
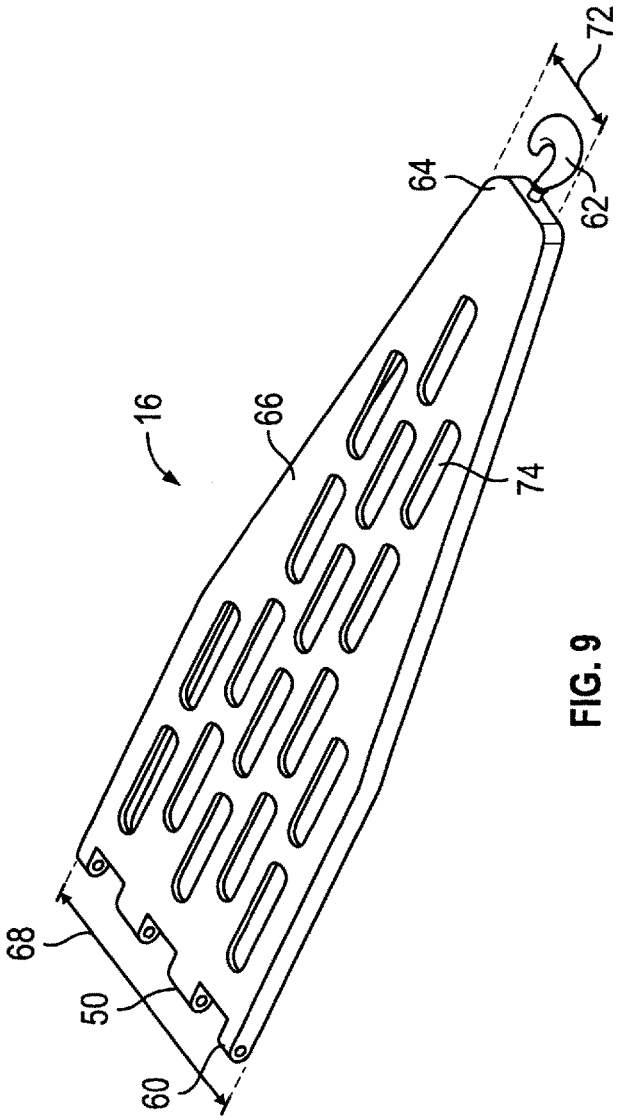
FIG. 9 shows a top perspective view of a step platform of the device of FIG. 1.
Figure 10:
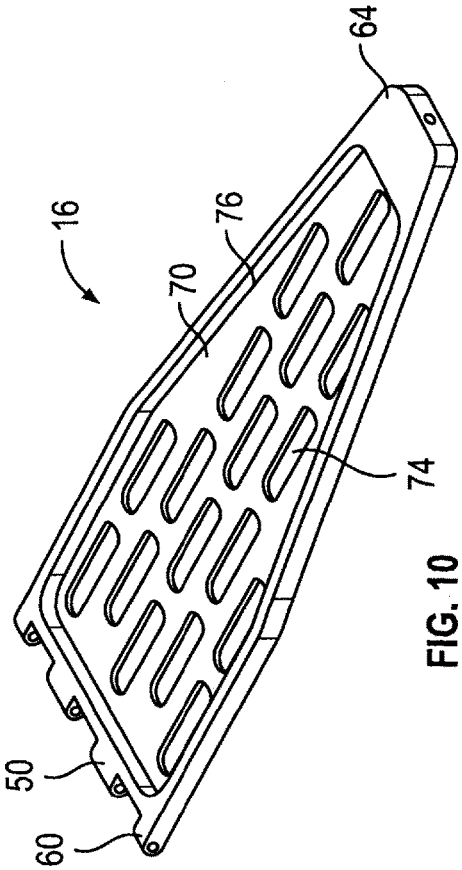
FIG. 10 shows a bottom perspective view of the step platform of FIG. 9.
Figure 14:
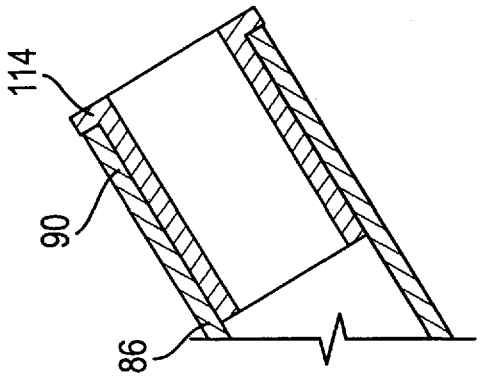
FIG. 14 shows a close-up cross-sectional view of an end portion of the telescopic rod of FIG. 12.
Figure 12:
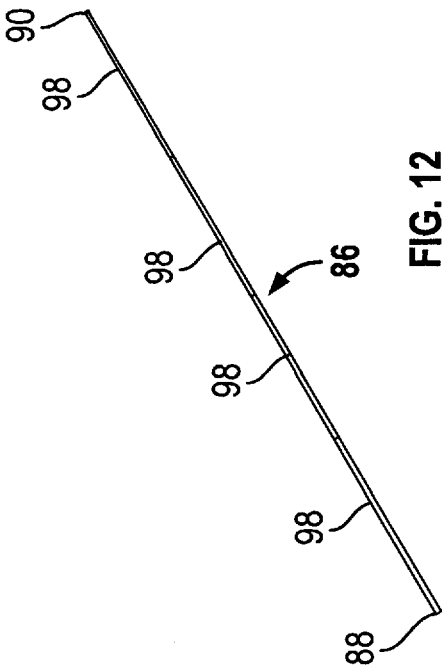
FIG. 12 shows a perspective view of a telescopic rod of the device of FIG. 1.

The towing member 16 is best shown in FIGS. 9 and 10 as a rigid aluminum step platform that extends from the hinge portion 50 at a first end 60 to a hook 62 at a second end 64. The towing member 16 has a size and shape selected to permit a person to stably step thereon, for example while installing the device 10. In particular, the towing member 16 has a flat upper surface 66, and a lateral width 68 of preferably at least 10 cm. In the preferred embodiment which is shown, the towing member 16 has dimensions of approximately 750 mm in length, 300 mm in width, and 24 mm in thickness (with a machined area 70 having a reduced thickness of 6 mm). The second end 64 is tapered to a reduced lateral width 72 that is smaller than the lateral width 68 of the first end 60. This reduced lateral width 72 at the second end 64 helps to avoid interference between the personal watercraft 12 and the towing member 16 during towing.

The towing member 16 has a plurality of splash holes 74 extending from a bottom surface 76 of the towing member 16 to the upper surface 66. The splash holes 74 allow water to pass through the towing member 16, reducing the forces that are experienced during towing through rough water, and thus help to reduce damage to the device 10 and the personal watercraft 12.

Figure 1:
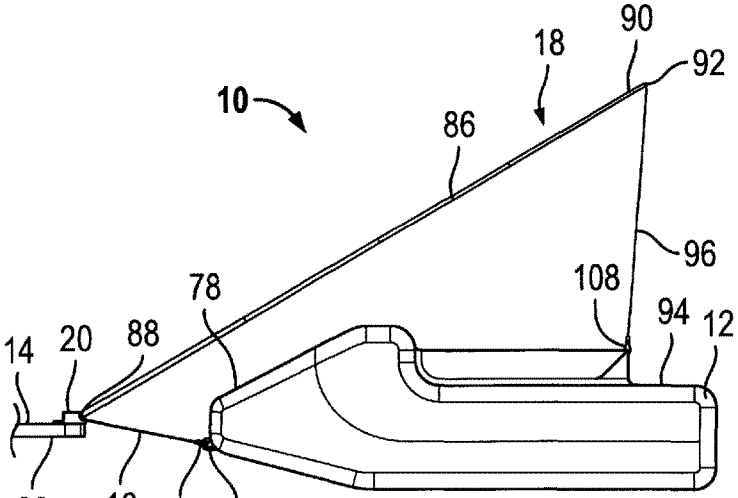
FIG. 1 shows a side view of a device for towing a personal watercraft.
Figure 2:
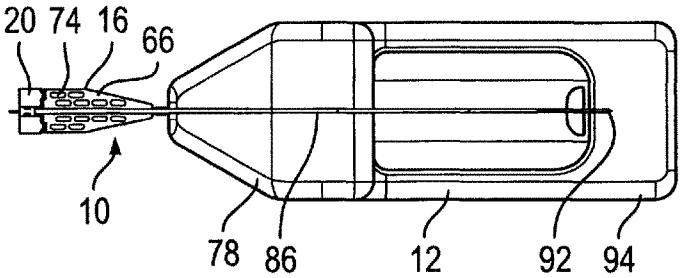
FIG. 2 shows a top view of the device of FIG. 1.
Figure 11:
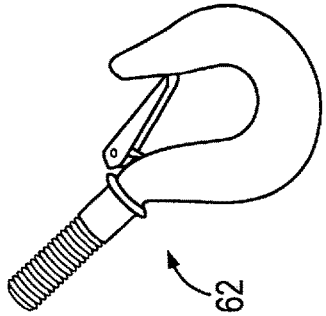
FIG. 11 shows a hook for connecting the step platform of FIG. 9 to the personal watercraft.

The hook 62 is best shown in FIG. 11, and is configured for attachment to a front portion 78 of the personal watercraft 12. The hook 62 may be made of stainless steel with a rubber cover, and a ½" (13 UNC) thread. As shown in FIG. 1, the hook 62 can connect to a metallic towing hoop 80 mounted to the front portion 78 of the personal watercraft 12. The connection of the hook 62 to the towing hoop 80 permits both vertical rotation and horizontal rotation of the personal watercraft 12 relative to the towing member 16, which reduces the stresses that are experienced during towing and thus helps to reduce damage to the device 10 and the personal watercraft 12.

As is best shown in FIG. 6, the connecting body 26 of the base 20 has a socket 82 arranged to face upwardly and rearwardly. The socket 82 is configured to rigidly mount the stabilizing member 18. The socket 82 has two button holes 84 which are used to secure the stabilizing member 18 in place, as will be described below.

As shown in FIG. 1, the stabilizing member 18 comprises a rigid telescopic rod 86 and a rope 96. The telescopic rod 86 extends from a first end 88 attached to the base 20, to a second end 90 positioned at a stabilization point 92 above the rear portion 94 of the personal watercraft 12. The ¼" rope 96 extends from the second end 90 of the rod 86 for attachment to the rear portion 94 of the personal watercraft 12.

Figure 13:
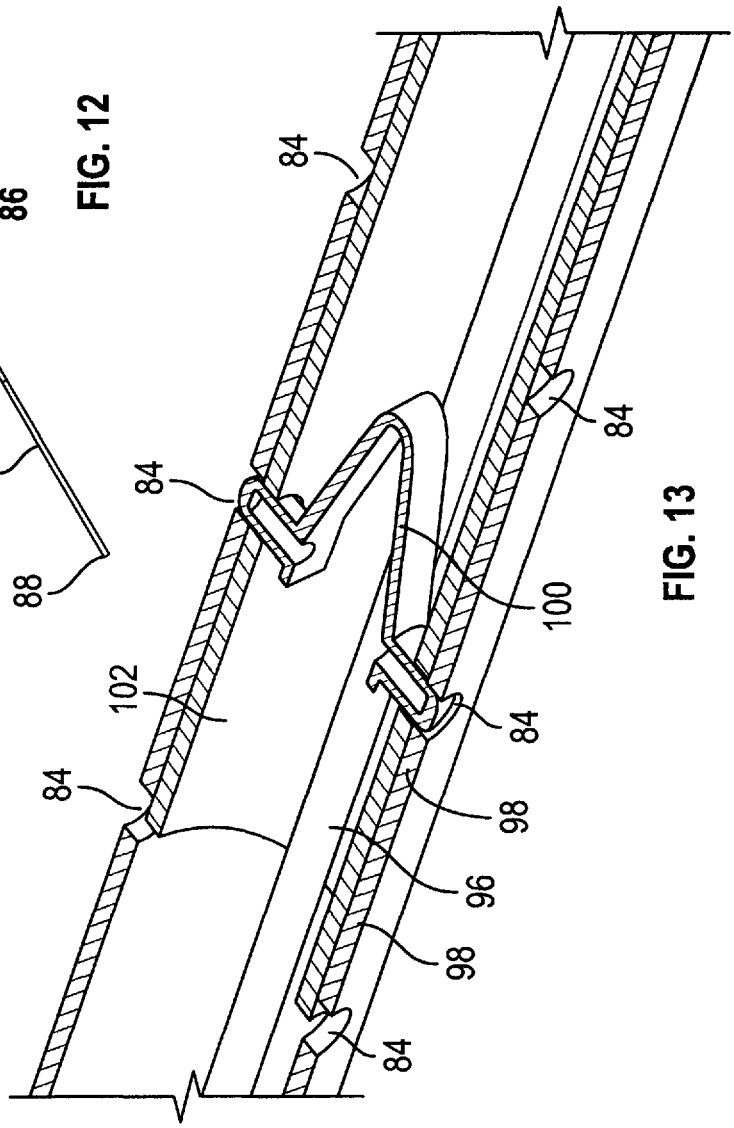
FIG. 13 shows a close-up cross-sectional view of a middle portion of the telescopic rod of FIG. 12.
Figure 18:
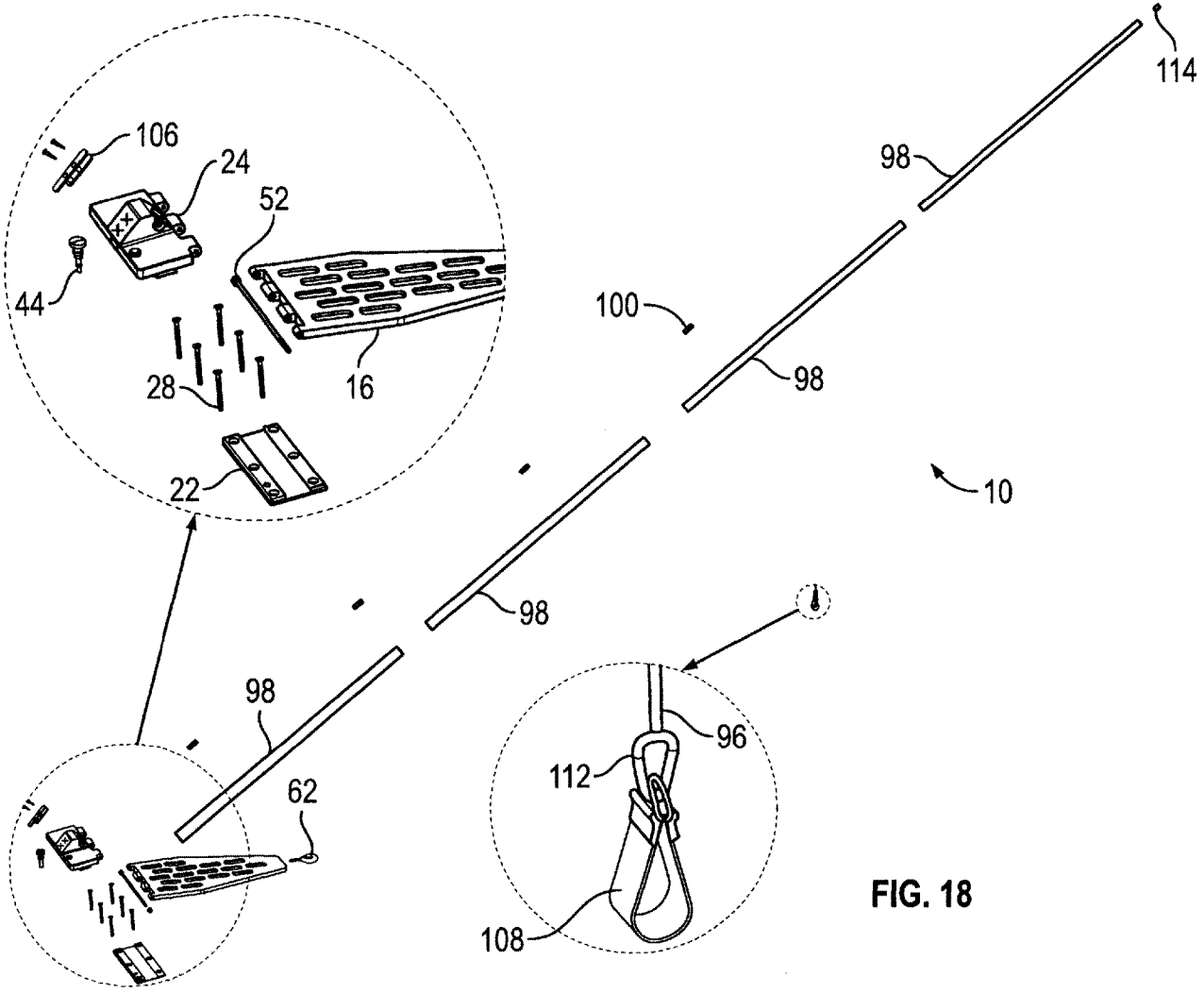
FIG. 18 shows an exploded view of the device of FIG. 1.

The telescopic rod 86 is best shown in FIG. 18 as comprising a number of tubular sections 98. As shown in FIG. 13, the tubular sections 98 are hollow and are configured to slide over one another to form the telescopic rod 86. The diameter of the tubular sections 98 decreases from the first end 88 to the second end 90. For example, in the exemplary embodiment which is shown, the four sections 98 have diameters of 2 inches, 1.75 inches, 1.5 inches, and 1.25 inches, respectively, going in order from the first end 88 to the second end 90. Each section 98 has a set of button holes 84, and a stainless steel quick release button connector 100 for releasably securing the adjacent sections 98 together. The length of the rod 86 is adjustable, by pushing in the button connector 100 and sliding the adjacent sections 98 together or apart, so that the button connector 100 aligns with a different set of button holes 84. In the embodiment which is shown, the button holes 84 are spaced in 3 inch increments, and the length of the rod 86 is 4.5 m when extended, adjustable in 3 inch increments up to 4.725 m and down to 4.275 m. When fully collapsed, the rod 86 has a collapsed length of 1.6 m. Each section 98 is 1400 mm long. A quick release button connector 100 is also used to releasably secure the first end 88 of the rod 86 to the socket 82 in the base 20. At the second end of the rod 86 is a bushing 114 to prevent chaffing of the rope 96.

Figure 17:
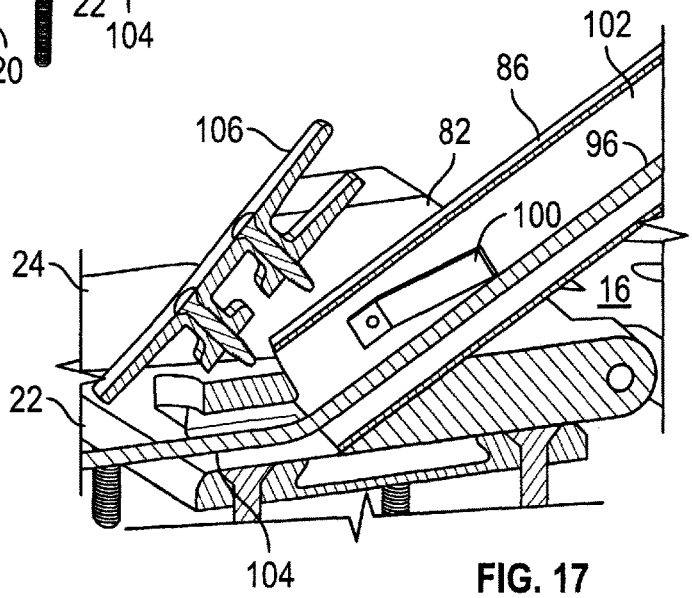
FIG. 17 shows a cross-sectional view of the base of FIG. 15.

The rope 96 extends from the base 20 to the second end 90 of the telescopic rod 86 through a channel 102 running lengthwise through the hollow rod 86, as best shown in FIGS. 13 and 17. At the first end 88 of the rod 86, the rope 96 extends through an opening 104 in the base 20 to the rear side of the base 20, where it can be adjustably secured to a cleat 106. The cleat 106 is attached to the connecting body 24 with screws. The length of the rope 96 extending from the second end 90 of the rod 86 can be adjusted by securing more or less of the rope 96 to the cleat 106. The tension in the rope 96 can also be adjusted by tightening or loosening the rope 96 when securing the rope 96 to the cleat 106.

Figure 4:
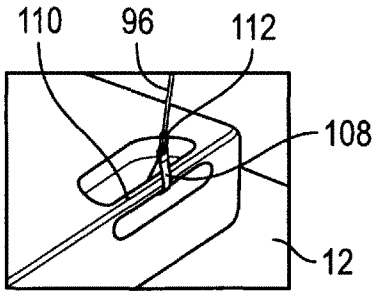
FIG. 4 shows a close-up view of the device of FIG. 1 connected to a rear grab handle of the personal watercraft.

The rope 86 has a carabiner style connector 112 with a strap 108 for attachment to the rear portion 94 of the personal watercraft 12. As shown in FIG. 4, the strap 108 may, for example, be attached to a rear grab handle 110 of the personal watercraft 12. The rope 96 may, for example, have a total length of 7 m.

When the device 10 is attached to the towing watercraft 14 and the personal watercraft 12 as shown in FIGS. 1 to 4, it can be used to stably and securely tow the personal watercraft 12 behind the towing watercraft 14. In particular, the towing member 16 is pulled forward by the towing watercraft 14, which in turn pulls the personal watercraft 12 forward.

The hinge connection 48 allows the towing member 16 to rotate vertically about the lateral axis 54, to accommodate for the vertical movement of the towing watercraft 14 and the personal watercraft 12 as they move over waves through a waterway. The connection of the hook 62 to the towing hoop 80 furthermore allows for some rotation of the personal watercraft 12 relative to the towing member 16 in all directions, to accommodate for motion of the personal watercraft 12 as it moves through the waterway. By allowing at least some motion in all directions, the device 10 and the personal watercraft 12 may experience less stress, and thus be less susceptible to damage that might otherwise occur if the connection between the towing member 16 and the personal watercraft 12 were rigid. The rigid construction of the towing member 16, together with the hinge connection 48 preventing rotation of the towing member 16 about the vertical axis 56, keeps the front portion 78 of the personal watercraft 12 substantially in longitudinal alignment with the base 20.

The stabilizing member 18 furthermore acts to limit lateral movement of the rear portion 94 of the personal watercraft 12 relative to the towing watercraft 14. In particular, the length of the rope 96 extending from the second end 90 of the rod 86 is selected to allow a limited range of motion of the rear portion 94 of the personal watercraft 12 relative to the stabilization point 92. If the rear portion 94 of the personal watercraft 12 begins to drift laterally relative to the towing watercraft 14, the tension of the rope 86 pulls the rear portion 94 towards the stabilization point 92, maintaining the personal watercraft 12 in substantial longitudinal alignment with the towing watercraft 14.

The device 10 is also able to maintain the proper spacing and alignment between the towing watercraft 14 and the personal watercraft 12 while backing up. In particular, when the personal watercraft 12 begins to drift longitudinally toward the towing watercraft 14 while backing up, the tension of the rope 86 pulls the rear portion 94 of the personal watercraft 12 backwards, toward the stabilization point 92 and away from the towing watercraft 14. The rigid towing member 16, because it is substantially incompressible, also acts to prevent the front portion 78 of the personal watercraft 12 from colliding with the swim platform 30 while backing up. The stabilizing member 18 furthermore maintains the longitudinal alignment of the personal watercraft 12 and the towing watercraft 14 in the manner as described above.

Because the rigid telescopic rod 86 provides a stabilization point 92 that is located over the rear portion 94 of the personal watercraft 12, it is able to provide effective stabilization of the rear portion 94. In particular, when the rear portion 94 of the personal watercraft 12 swings out laterally, the body of the personal watercraft 12 effectively acts as a lever, with the force experienced at the front 78 of the personal watercraft 12 being significantly amplified. By stabilizing the rear portion 94 of the personal watercraft 12 from a stabilization point 92 located directly above the rear portion 94, the stabilization member 18 avoids this levered amplification of force. As such, the device 10 of the present invention is much more effective at stabilizing the rear portion 94 of the personal watercraft 12, as compared, for example, to an alternative towing arrangement configured to stabilize the personal watercraft 12 only from a point at the front 78 of the personal watercraft 12. Furthermore, if the rear portion 94 of the personal watercraft 12 were stabilized from an attachment point at the front 78 of the personal watercraft 12 only, the amplified forces could damage the personal watercraft 12.

It is to be appreciated that the invention is not limited to the specific preferred embodiments that have been described. For example, the towing member 16 need not be in the form of a step platform, and could be another rigid body instead, such as a cylinder. In some embodiments, the towing member 16 need not be rigid at all, and could be flexible such as a rope or chain. In such embodiments, the personal watercraft 12 could be prevented from colliding with the swim platform 30 of the towing watercraft 14 through tension in the rope 96 pulling the personal watercraft 12 toward the stabilization point 92, longitudinally away from the swim platform 30.

It is furthermore to be appreciated that the stabilizing member 18 need not specifically comprise a telescopic rod 86 and a rope 96 as described in the preferred embodiment. Rather, the telescopic rod 86 could be replaced with any suitably rigid body that can extend from the rear of the towing watercraft 14 to a stabilization point 92 above the rear portion 94 of the personal watercraft 12. For example, an elongated cone or beam could be used instead. The rope 96 could also be replaced with any suitable means for attaching the rod 86 to the rear portion 94 of the personal watercraft 12. For example, in some embodiments the rod 86 could be connected to the personal watercraft 12 by a solid connection. Preferably, a flexible line member such as the rope 96, a chain, a cable, an elastic cord or the like is used to connect the rod 86 to the personal watercraft 12. Some flexibility is desired to permit limited movement of the personal watercraft 12, to prevent the excessive stresses that could be encountered if a rigid connection were used.

When the rod 86 is described as being rigid, it is intended to convey that the rod 86 is relatively resistant to deformation, such that it is able to provide and maintain a stabilization point 92 above the rear portion 94 of the personal watercraft 12. The stabilization point 92 need not remain in precisely the same location relative to the towing watercraft 14 or the personal watercraft 12 during towing. It is to be appreciated that the rod 86 may exhibit some degree of flexibility, and may for example bend along its length during turning or the like. Some degree of resilient flexibility may be advantageous, so that the rod 86 may dissipate some of the forces experienced over its length. Preferably, the rod 86 bends no more than 45 degrees along its length during normal operation. More preferably, the rod 86 bends no more than 15 degrees during normal operation. The rod 86 may be constructed from any suitable material exhibiting sufficient rigidity and strength, such as aluminum or other hard metals and plastics.

It is to be understood that the invention need not use the base 20 construction as described in the preferred embodiments. Rather, any suitable construction for securing the towing member 16 and the stabilizing member 18 to the towing watercraft 14 could be used. In some embodiments, the towing member 16 and the stabilizing member 18 may attach to the towing watercraft 14 at different locations, rather than at a single base 20. The towing member 16 and the stabilizing member 18 may furthermore be configured to connect directly to the towing watercraft 14, without requiring a base 20 at all. The device 10 could also attach to a part of the towing watercraft 14 other than the swim platform 30, if desired. The base plate 22 may, for example, be secured to the swim platform 30 by six ⅜" (16 UNC) stainless steel screws. It may also be bolted to the swim platform 30.

It is to be appreciated that the device 10 could be adapted for towing various types of watercraft such as a water scooter, a dingy, a canoe, a row boat, a sail boat, or a motor boat. The towing watercraft 14 could be a motorized yacht, a motor boat, or any other suitable watercraft capable of towing another watercraft.

All of the connection mechanisms described for attaching the various components of the device 10 together, and for attaching the device 10 to the watercraft 12 and 14, could be replaced with any suitable alternative connection mechanisms known to a person skilled in the art.

In the preferred embodiment of the invention which is shown in the Figures, the device 10 is configured to be easily disassembled for storage. In particular, the base connecting body 24 can be removed from the base plate 22, and the towing member 16 and the stabilizing member 18 can be removed from the connecting body 24. The towing member 16 and the stabilizing member 18 can of course also be detached from the personal watercraft 12. The telescopic rod 86 can furthermore be collapsed to a significantly reduced length, for easy storage when not in use.

The length of the rod 86 is selected so that it can extend from the rear of the towing watercraft 14 to a stabilization point 92 above the rear portion 94 of the personal watercraft 12. The appropriate length depends on the length of the personal watercraft 12. Preferably, the length of the rod 86 is adjustable, so that the rod 86 may be used with a variety of personal watercraft 12 of differing lengths. When a water scooter is being towed, generally a length of at least 4 m is required.

Reference is now made to FIGS. 19 to 26, which show a device 10 for towing a personal watercraft 12 in accordance with a second preferred embodiment of the invention, wherein like numerals are used to represent like components. The device 10 is generally similar to that shown in FIGS. 1 to 18, with a number of additional features.

Figure 19:
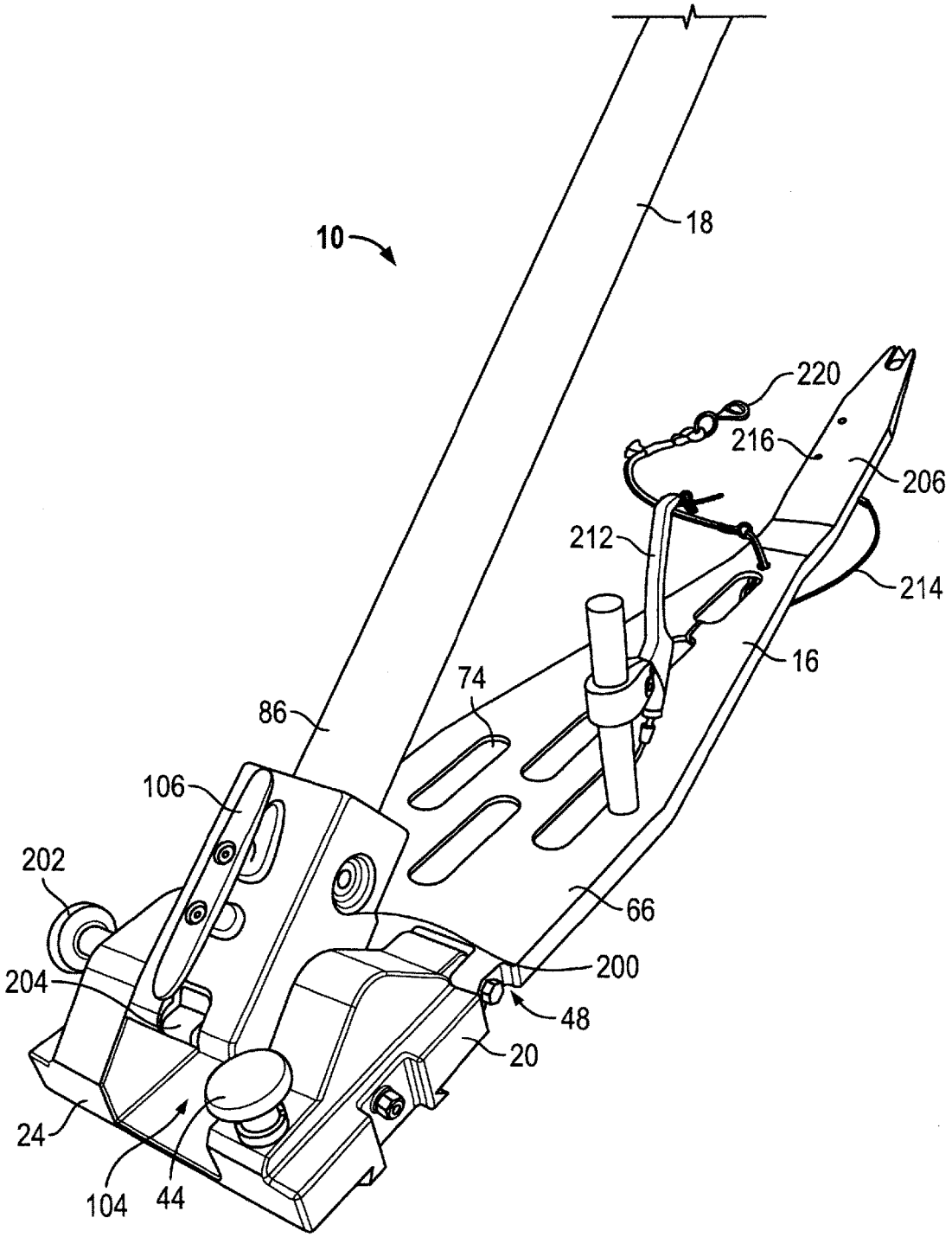
FIG. 19 shows a perspective rear view of a device for towing a personal watercraft, in accordance with a second embodiment of the invention.
Figure 23:
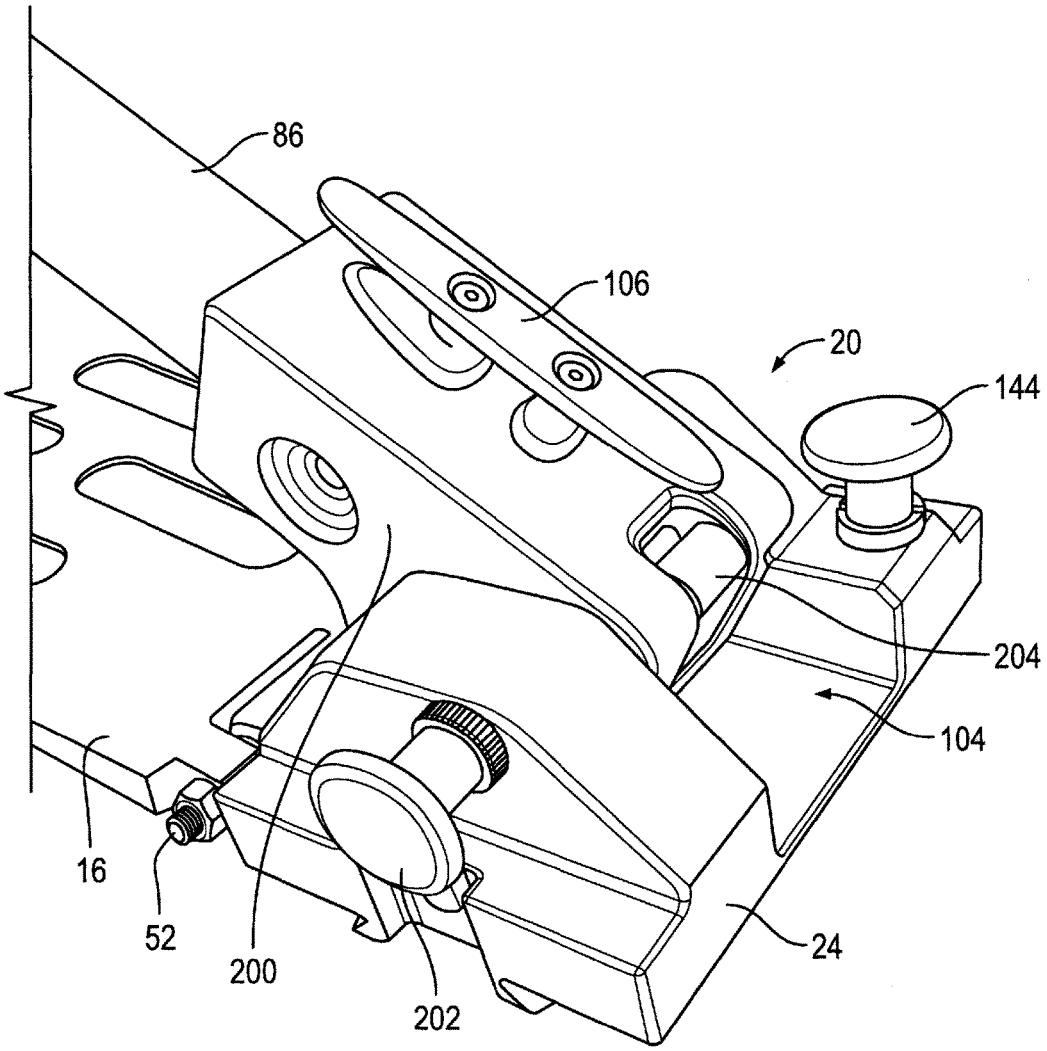
FIG. 23 shows a close-up view of a rod connecting body of the device of FIG. 19, with the rod connecting body shown in an angled position.
Figure 24:
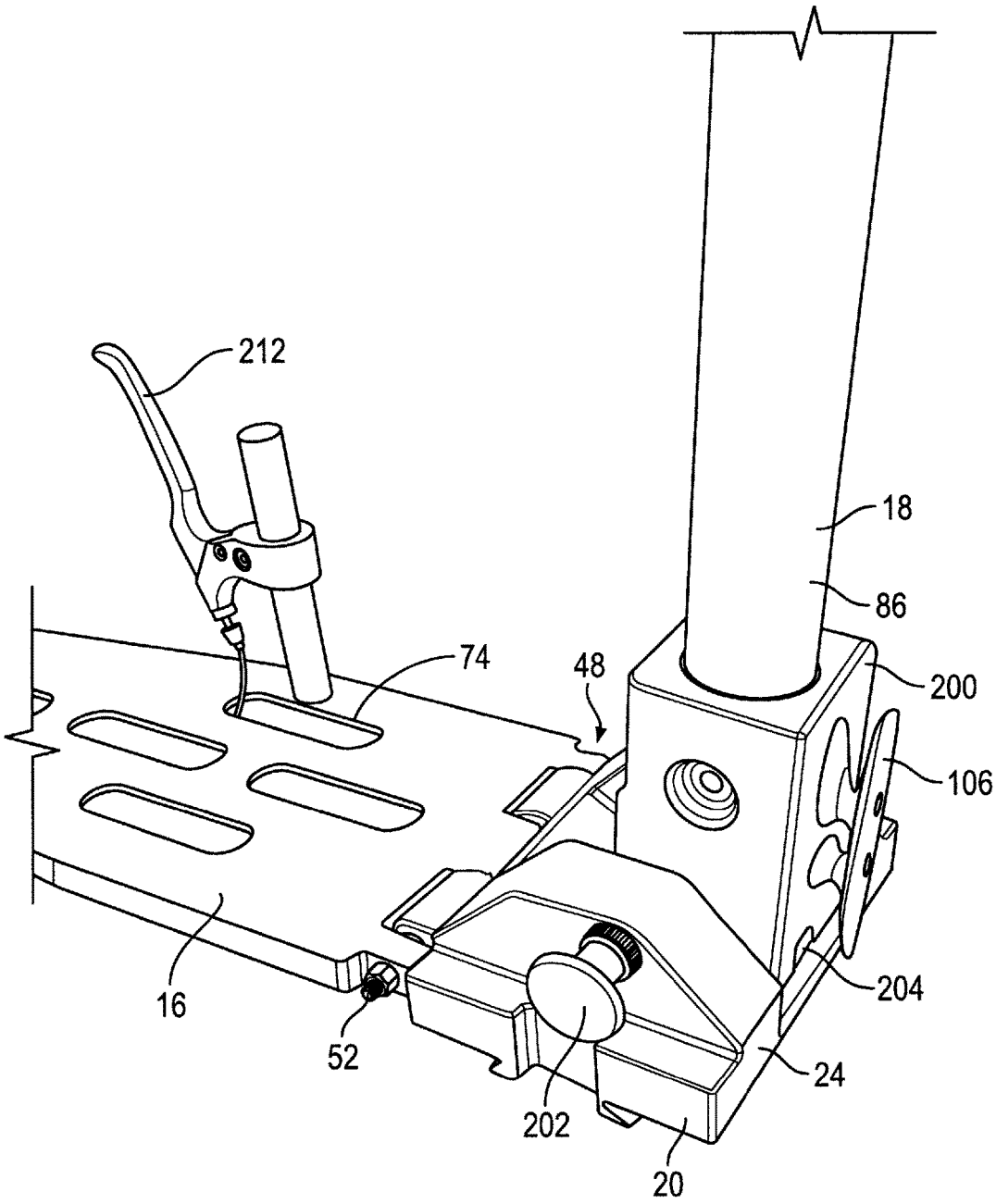
FIG. 24 shows a close-up view of the rod connecting body of FIG. 23, with the rod connecting body shown in a vertical position.

As is best shown in FIGS. 19, 23 and 24, the base connecting body 24 of the device 10 incorporates a selectively rotatable rod connecting body 200, for receiving the telescopic rod 86. A spring loaded pin 202 is used to hold the rod connecting body 200 at a selected angle. When the pin 202 is pulled laterally outwards, the rod connecting body 200 can be rotated to the desired angle, such as the forward angled position shown in FIG. 23 or the vertical position shown in FIG. 24. When the spring loaded pin 202 is released, the rod connecting body 200 is locked at the selected angle. This permits the angle of the telescoping rod 86 to be adjusted. Also, in some embodiments of the invention, it may be easier to collapse the telescoping rod 86 when in the vertical position.

As is best shown in FIG. 23, the rod connecting body 200 includes a roller 204 that is positioned under the cleat 106. The roller 204 reduces the friction between the rope 96 and the base 20, making it easier to tighten and adjust the rope 96.

Figure 20:
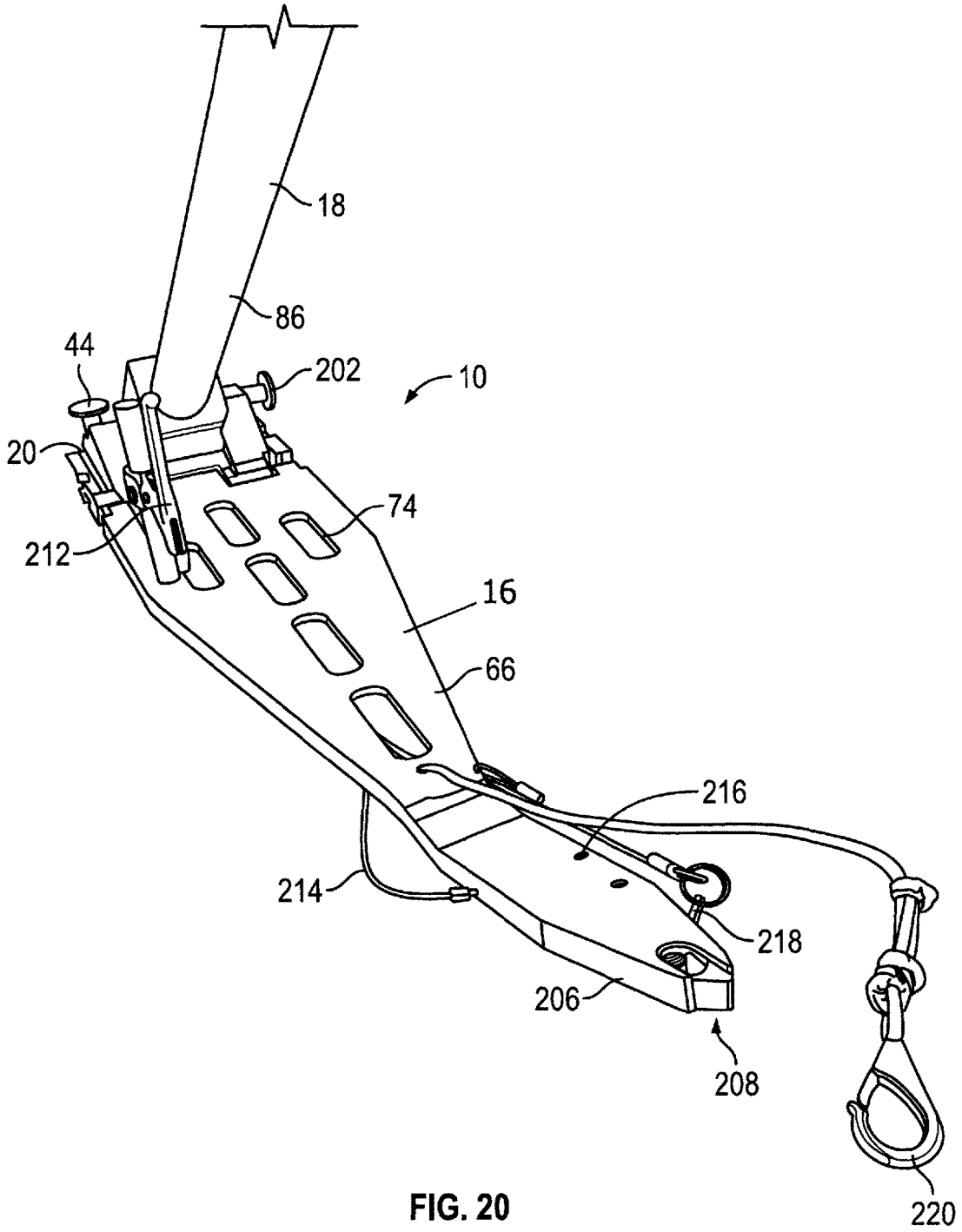
FIG. 20 shows a perspective front view of the device of FIG. 19.

As can be seen in FIGS. 19 and 20, the towing member 16 includes a tongue member 206 that extends from the step platform. The tongue member 206 is bent slightly upwards, and has a first 15 degree bend followed by a second 10 degree bend. The angle and shape of the tongue member 206 are selected to prevent the front of the personal watercraft 12 from rubbing against the towing member 16.

Figure 21:
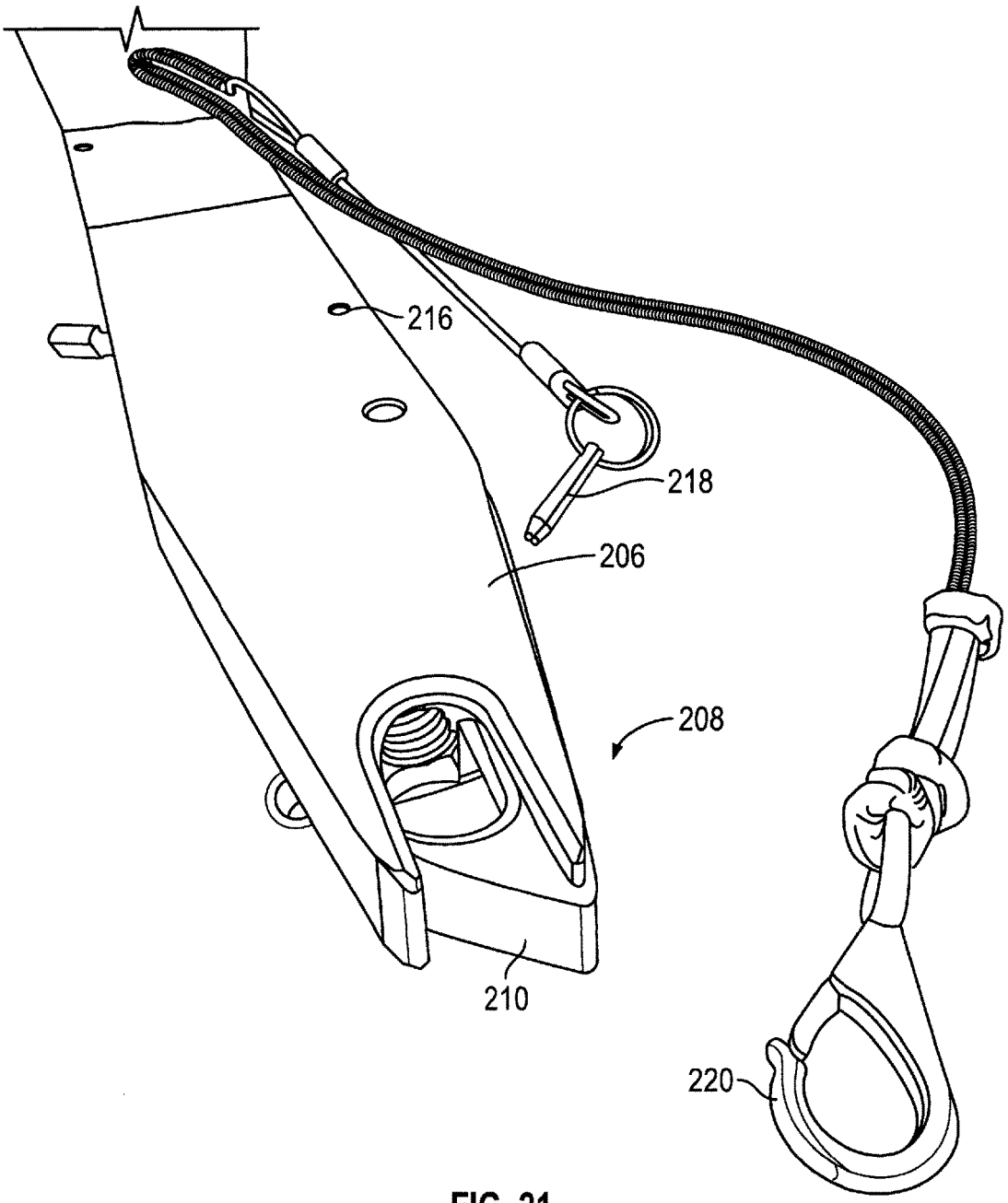
FIG. 21 shows a close-up view of a controllable snap hook of the device of FIG. 19, with the hook shown in a closed position.
Figure 22:
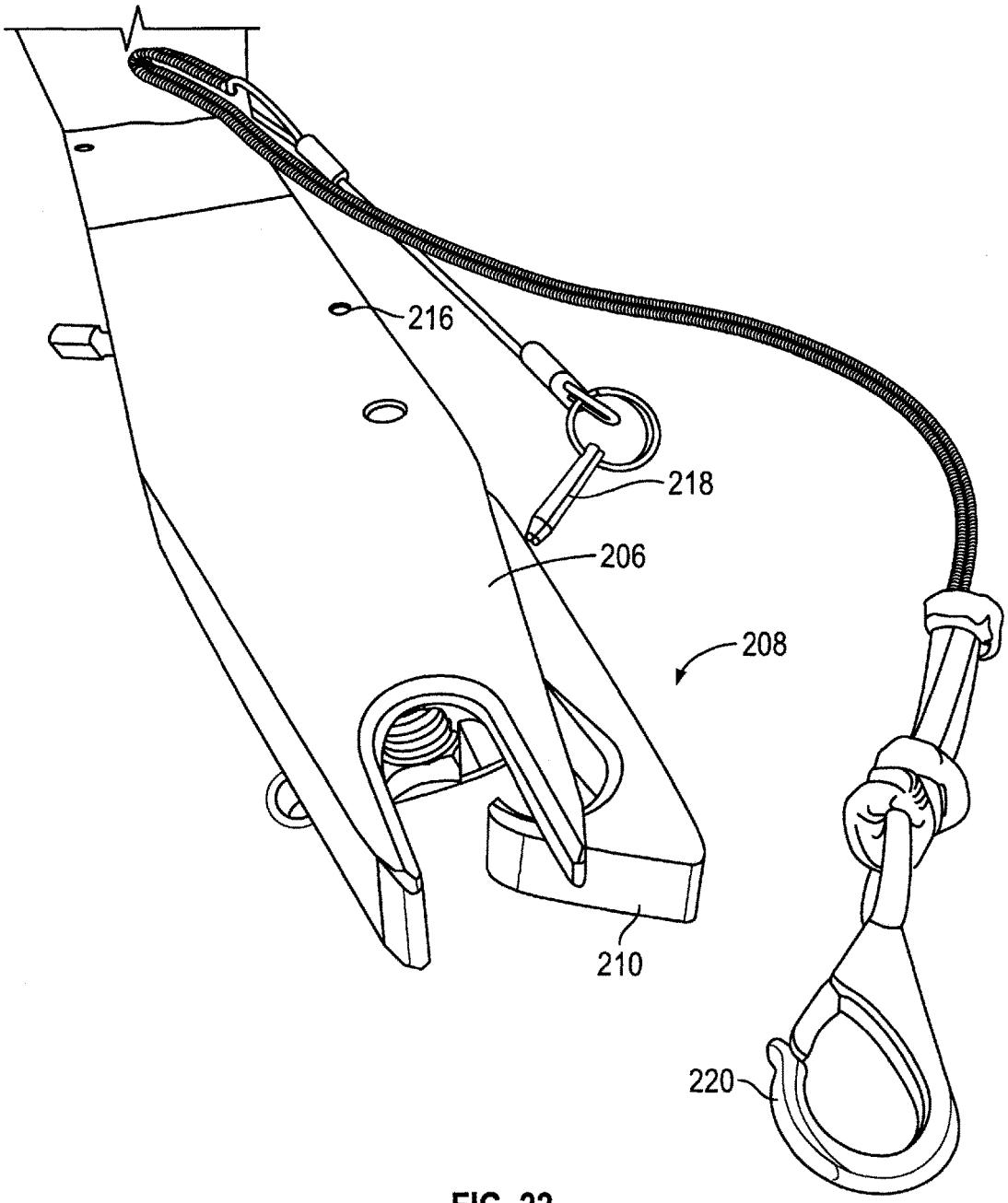
FIG. 22 shows a close-up view of the controllable snap hook of FIG. 21, with the hook shown in an open position.

As is best shown in FIGS. 21 and 22, the tongue member 206 has a controllable snap hook 208 for connecting to the towing hoop 80 of the personal watercraft 12. The snap hook 208 has a cam surface 210 that, when pressed against the towing hoop 80, moves the hook 208 from the closed position, shown in FIG. 21, to the open position, shown in FIG. 22. Once the towing hoop 80 is received by the hook 208, an internal spring returns the hook 208 to the closed position, with the towing hoop 80 held therein.

The towing member 16 also includes a control mechanism 212 for manually opening the snap hook 208, for example to selectively release the towing hoop 80. In the embodiment which is shown, the control mechanism 212 is a modified bicycle brake, with a cable 214 connected to the tongue member 206 for moving the snap hook 208 between the open and closed positions. The control mechanism 212 may take any desired form, such as a finger pull mechanism.

As a safety feature to prevent the unintended opening of the snap hook 208, the tongue member 206 includes a pin hole 216 for receiving a safety pin 218. When the safety pin 218 is held in the pin hole 216, the hook 208 is prevented from opening. As an additional safety feature, a safety hook 220 is also used to connect the towing member 16 to the towing hoop 80, as a back-up in the event that the snap hook 208 fails or opens unintentionally.

Figure 25:
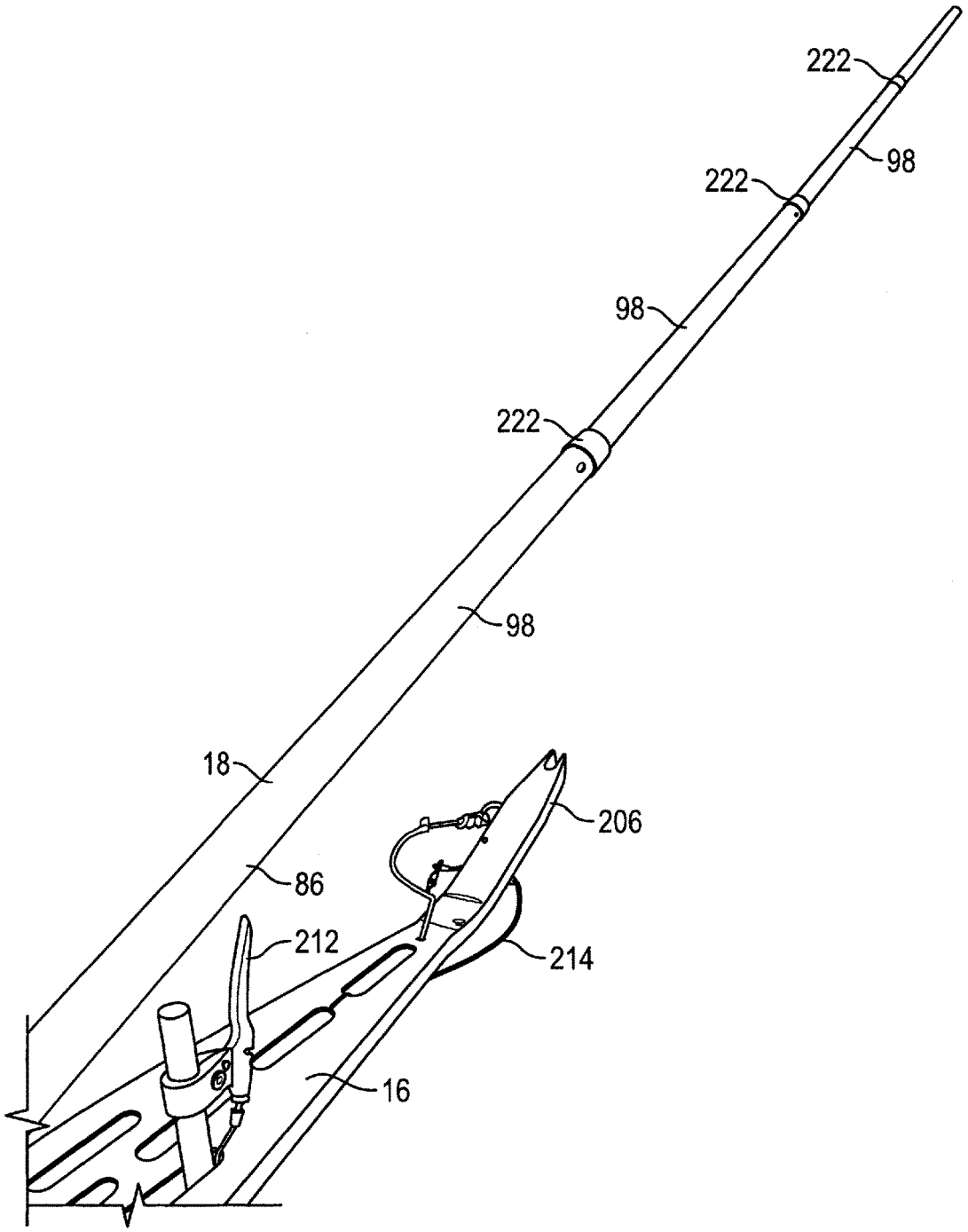
FIG. 25 shows a perspective view of a telescoping rod of the device of FIG. 19.
Figure 26:
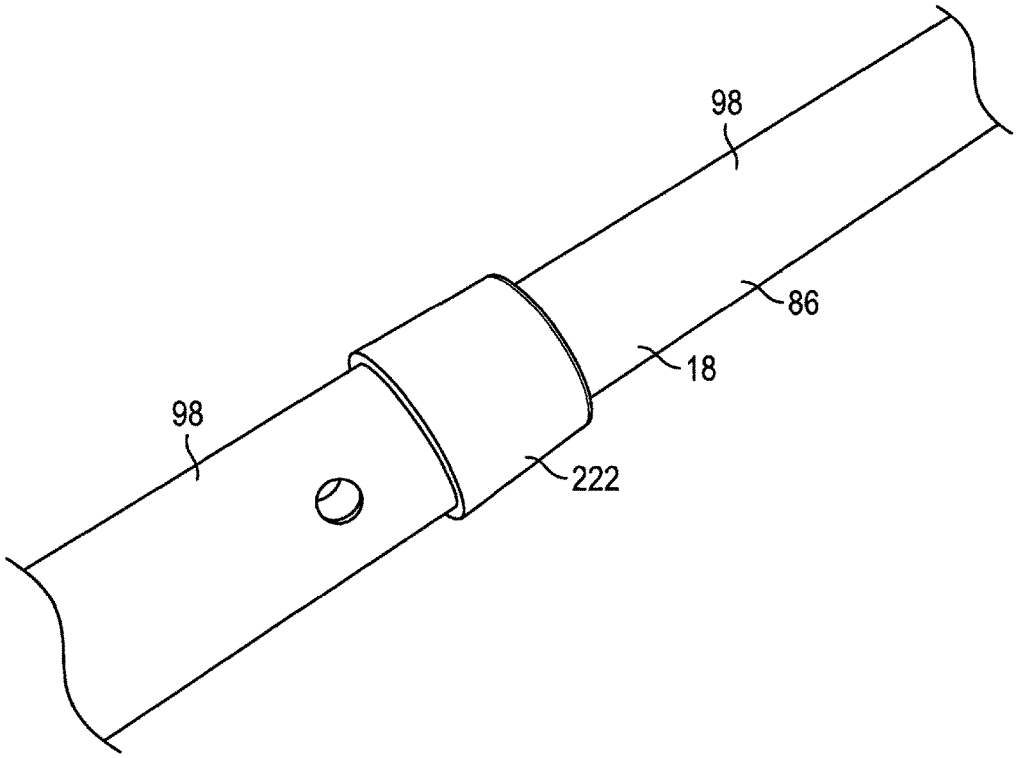
FIG. 26 shows a close-up view of a collar of the telescoping rod of FIG. 25.

As is best shown in FIGS. 25 and 26, the fiberglass telescopic rod 86 includes aluminum collars 222 at the ends of each of the tubular sections 98. These help to prevent cracks from forming at the ends of the tubular sections 98.

The device 10 shown in FIGS. 19 to 26 operates in much the same way as the embodiment shown in FIGS. 1 to 18.

It will be understood that, although various features of the invention have been described with respect to one or another of the embodiments of the invention, the various features and embodiments of the invention may be combined or used in conjunction with other features and embodiments of the invention as described and illustrated herein.

Although this disclosure has described and illustrated certain preferred embodiments of the invention, it is to be understood that the invention is not restricted to these particular embodiments. Rather, the invention includes all embodiments which are functional or mechanical equivalents of the specific embodiments and features that have been described and illustrated herein.

We claim:

1. A device for towing a personal watercraft behind a towing watercraft, comprising:

a base configured for attachment to a rear portion of the towing watercraft;

a rigid towing member extending between a first towing member end and a second towing member end, the first towing member end having an associated first connecting portion that connects the first towing member end to the base, the first connecting portion being configured to permit vertical rotation of the towing member relative to the base about a lateral axis, and to prevent rotation of the towing member relative to the base about a vertical axis and a longitudinal axis, the second towing member end having an associated second connecting portion that is configured for attachment to a front portion of the personal watercraft; and a stabilizing member comprising:

an elongated rigid body extending between a first elongated body end and a second elongated body end, the first elongated body end being rigidly connected to the base, the elongated rigid body being configured to extend from the base over the personal watercraft, with the second elongated body end positioned above a rear portion of the personal watercraft, and a connecting member that extends from the second elongated body end for attachment to the rear portion of the personal watercraft, the connecting member being configured to limit lateral movement of the rear portion of the personal watercraft relative to the towing watercraft.

2. The device according to claim 1, wherein the base is configured for attachment to a swim platform of the towing watercraft.

3. The device according to claim 1, wherein the base comprises:

a plate that is configured to be secured to the rear portion of the towing watercraft; and a connecting body that is releasably secured to the plate;

wherein the first towing member end and the first elongated body end are connected to the connecting body.

4. The device according to claim 3, wherein the connecting body has an elongated dovetail shaped projection; and wherein the plate has a complementary dovetail shaped channel for slidingly receiving the dovetail shaped projection.

5. The device according to claim 3, wherein the base further comprises a spring-loaded pin for releasably securing the connecting body to the plate.

6. The device according to claim 1, wherein the first connecting portion comprises a hinge with a selectively removable pin that extends along the lateral axis; and wherein the rigid towing member is configured to disconnect from the base when the pin is removed.

7. The device according to claim 1, wherein the rigid towing member comprises a step platform.

8. The device according to claim 1, wherein the second connecting portion is configured to allow horizontal rotation and vertical rotation of the personal watercraft relative to the rigid towing member.

9. The device according to claim 1, wherein the second connecting portion comprises a hook.

10. The device according claim 1, wherein a length of the connecting member extending from the second elongated body end is adjustable.

11. The device according to claim 1, wherein a length of the elongated rigid body is adjustable.

12. The device according to claim 1, wherein the elongated rigid body is selectively removable from the base.

13. The device according to claim 1, wherein the connecting member comprises a flexible line member.

14. The device according to claim 13, wherein the elongated rigid body comprises a rod.

15. The device according to claim 14, wherein the rod is a telescopic rod.

16. The device according to claim 15, wherein the telescopic rod comprises a plurality of tubular sections that are connected by quick release button connectors.

17. The device according to claim 15, wherein the telescopic rod is releasably secured to the base by a quick release button connector.

18. The device according to claim 15, wherein the telescopic rod has an extended length of at least 4 m and a collapsed length of less than 2 m.

19. The device according to claim 14, wherein the rod defines an internal channel and the line member extends from the base to the second elongated body end through the internal channel.

20. The device according to claim 19, wherein the base comprises a cleat for adjustably securing the line member to the base.

21. The device according to claim 13, wherein the line member comprises a rope.

22. The device according to claim 13, wherein a tension of the line member is adjustable.

23. The device according to claim 1, wherein the connector member is configured to attach to a rear grab handle of the personal watercraft.

24. The device according to claim 1, wherein the rigid towing member has a flat upper surface.

25. The device according to claim 24, wherein the rigid towing member has a lateral width of at least 10 cm.

26. The device according to claim 24, wherein the first towing member end has a first lateral width and the second towing member end has a second lateral width, the first lateral width being greater than the second lateral width.

27. The device according to claim 24, wherein the rigid towing member has a plurality of holes extending from a bottom surface of the rigid towing member to the flat upper surface.

28. A method of towing a personal watercraft behind a towing watercraft using a device comprising:

a base configured for attachment to a rear portion of the towing watercraft;

a rigid towing member extending between a first towing member end and a second towing member end, the first towing member end having an associated first connecting portion that connects the first towing member end to the base, the first connecting portion being configured to permit vertical rotation of the towing member relative to the base about a lateral axis, and to prevent rotation of the towing member relative to the base about a vertical axis and a longitudinal axis, the second towing member end having an associated second connecting portion that is configured for attachment to a front portion of the personal watercraft; and a stabilizing member comprising:

an elongated rigid body extending between a first elongated body end and a second elongated body end, the first elongated body end being rigidly connected to the base, the elongated rigid body being configured to extend from the base over the personal watercraft, with the second elongated body end positioned above a rear portion of the personal watercraft, and a connecting member that extends from the second elongated body end for attachment to the rear portion of the personal watercraft, the connecting member being configured to limit lateral movement of the rear portion of the personal watercraft relative to the towing watercraft;

the method comprising:

attaching the base to the rear portion of the towing watercraft;

attaching the second towing member end to the front portion of the personal watercraft using the associated second connecting portion;

attaching the connecting member to the rear portion of the personal watercraft; and moving the towing watercraft forward through a waterway, with the device pulling the personal watercraft behind the towing watercraft.

* * * * *